US010280042B2

(12) United States Patent
Jung et al.

(10) Patent No.: US 10,280,042 B2
(45) Date of Patent: May 7, 2019

(54) METHOD AND APPARATUS FOR STALL CONTROL OF ELEVATOR DOOR

(71) Applicant: Otis Elevator Company, Farmington, CT (US)

(72) Inventors: WoonCheol Jung, Seoul (KR); Hansoo Shim, Uiwang-si (KR)

(73) Assignee: OTIS ELEVATOR COMPANY, Farmington, CT (US)

( * ) Notice: Subject to any disclaimer, the term of this patent is extended or adjusted under 35 U.S.C. 154(b) by 88 days.

(21) Appl. No.: 15/478,482

(22) Filed: Apr. 4, 2017

(65) Prior Publication Data

US 2018/0282128 A1 Oct. 4, 2018

(51) Int. Cl.
*B66B 5/26* (2006.01)
*B66B 13/14* (2006.01)

(52) U.S. Cl.
CPC ..... *B66B 13/146* (2013.01)

(58) Field of Classification Search
CPC ..... B66B 13/146
USPC ..... 187/316
See application file for complete search history.

(56) References Cited

U.S. PATENT DOCUMENTS 4,299,308 A * 11/1981 Shung ..... G05D 3/12 187/316
4,300,660 A * 11/1981 Schoenmann ..... B66B 13/26 187/316
4,300,661 A * 11/1981 Hmelovsky ..... G05D 3/12 187/316
4,300,662 A * 11/1981 Hmelovsky ..... G05D 3/12 187/316
4,300,663 A * 11/1981 Hmelovsky ..... B66B 13/14 187/316
4,305,480 A * 12/1981 Hmelovsky ..... G05D 3/00 187/316
4,305,481 A * 12/1981 Hmelovsky ..... G05B 19/416 187/316
4,308,935 A 1/1982 Deric
(Continued)

FOREIGN PATENT DOCUMENTS

CN 202594587 U 12/2012
CN 102205924 B 8/2013
(Continued)

OTHER PUBLICATIONS

EEM Elevator Control and Automation Systems, "Lift Door Controller / Smart Door—Automatic Door Control", available at : http://www.eem.com.tr/smart-door-automatic-door-control_8_en_u.html, accessed Feb. 13, 2017, 1 pg.
(Continued)

*Primary Examiner* — Jeffrey Donels
(74) *Attorney, Agent, or Firm* — Cantor Colburn LLP

(57) ABSTRACT

A method of updating a stall threshold level of an elevator door to control a door stall occurring during opening or closing of the elevator door includes determining an exceptional motion count of a door based on at least one of a speed and an acceleration of the door, determining whether the door is stalled, based on a determined exceptional motion count of the door and a preset stall threshold level of the door, and re-determining the stall threshold level of the door according to the determination of whether the door is stalled.

15 Claims, 6 Drawing Sheets

(56) References Cited

U.S. PATENT DOCUMENTS

| | | | | |
|---|---|---|---|---|
| 4,342,378 | A * | 8/1982 | Hmelovsky | G05B 19/416 187/316 |
| 4,342,379 | A * | 8/1982 | Games | G05B 19/416 187/316 |
| 4,367,810 | A * | 1/1983 | Doane | B66B 13/18 187/280 |
| 4,776,433 | A | 10/1988 | Lagree et al. | |
| 5,706,913 | A | 1/1998 | Rivera | |
| 5,708,338 | A | 1/1998 | Cook et al. | |
| 5,770,934 | A | 6/1998 | Theile | |
| 6,543,582 | B2 | 4/2003 | DiFranza et al. | |
| 7,548,037 | B2 | 6/2009 | Boisvert et al. | |
| 2004/0168863 | A1 | 9/2004 | Reynolds et al. | |

FOREIGN PATENT DOCUMENTS

| | | |
|---|---|---|
| CN | 205294529 U | 6/2016 |
| EP | 1544151 A1 | 6/2005 |

OTHER PUBLICATIONS

European Search Report for application EP 18165686.9, dated Sep. 24, 2018, 11 pages.

* cited by examiner

METHOD AND APPARATUS FOR STALL CONTROL OF ELEVATOR DOOR

TECHNICAL FIELD

The present disclosure relates to a motion control of an elevator door, and more particularly, to an elevator door stall control.

BACKGROUND ART

An elevator door performs an opening or closing motion on a platform of a floor where the elevator is supposed to be stopped, during which passengers may get on or off the elevator.

An exceptional motion of an elevator door signifies a motion of an elevator door that does not conform to a door movement speed command of a door controller when the elevator door is opening or closing. A door stall has been known as one of the exceptional motions of an elevator door. The door stall may signify a state in which a door stands still or moves at a remarkable slow speed compared to a normal movement speed, not conforming to the speed or position command given by the door controller. The door stall is an exceptional motion of an elevator door caused by passengers or an elevator installation state such as mechanical friction between a door and a door sill. When door stall is detected, it is regarded as passenger touch or blockage, the applied force should be controlled to prevent blocking passenger damage or door mechanical damage.

When an elevator is installed, a door stall threshold level needs to be appropriately set for smooth opening/closing of a door. The door stall threshold level is a maximum threshold value of the negligible occurrence of exceptional motions of a door, which may be previously set at a production stage of the elevator door system or to a value considering the opening width of a door, door mass, and installation conditions at the site after installation and before operation of an elevator.

According to the related art, in order to find a door stall threshold level suitable for an elevator installation state, a skilled operator needs to manually and repeatedly adjust a door stall threshold level using a special input device in an initial setup process after installation of an elevator, which is a complex and inconvenient process.

Accordingly, an elevator door stall control method, which can automatically detect a door stall threshold level suitable for the elevator installation state and accordingly handle a door stall, is demanded.

SUMMARY

The present disclosure is directed to a method and apparatus for stall control of an elevator door.

In accordance with one aspect of the present disclosure, there is a method to update a stall threshold level of an elevator door to control a door stall occurrence during opening or closing of the elevator door, the method comprising, determining an exceptional motion count of a door based on at least one of a speed and an acceleration of the door, determining whether the door is stalled, based on a determined exceptional motion count of the door and a preset stall threshold level of the door, and re-determining the stall threshold level of the door according to the determination of whether the door is stalled.

Preferably, in the determining of the exceptional motion count, the exceptional motion count is determined with respect to at least one preset position or position range on a pathway of the door.

Preferably, the determining of the exceptional motion count comprises, if the speed of the door is less than a minimum acceptable speed, increasing a first count, and if the acceleration of the door is greater than a maximum acceptable acceleration, increasing a second count, wherein the exceptional motion count is determined based on at least one of the first count and the second count.

Preferably, the exceptional motion count is determined by summing a first weighted count and a second weighted count that are determined by applying a weight to each of the first count and the second count.

Preferably, each of the minimum acceptable speed and the maximum acceptable acceleration is determined based on at least one of a position on a pathway of the door and a movement speed profile of the door.

Preferably, in the determining of whether the door is stalled, the door is determined to be stalled when the determined exceptional motion count is greater than or equal to the preset stall threshold level.

Preferably, in the re-determining of the stall threshold level, a current position of the door is determined to be a stall position, and a value obtained by increasing the preset stall threshold level by a predetermined increment is re-determined as a stall threshold level with respect to the stall position.

Preferably, the stall threshold level is set to be a different value according to each position on the pathway of the door on a platform.

Preferably, the stall threshold level is set to be a different value according to each floor that the elevator is stopped.

Preferably, the method is automatically started according to whether the preset stall threshold level of the door is updated or manually started by an external command.

In accordance with one aspect of the present disclosure, there is provided a method of controlling a stall of an elevator door occurring during opening or closing of the elevator door, the method comprising, determining an exceptional motion count of a door based on at least one of a speed and an acceleration of the door, determining whether the door is stalled, based on a determined exceptional motion count of the door and a preset stall threshold level of the door, and selecting a subsequent motion of the door according to the determination of whether the door is stalled, wherein, in the selecting of the subsequent motion, when the door approaches a stall position, at least one of a first motion of tuning a motion of the door and a second motion of increasing a determined stall threshold level by a predetermined increment is selected as the subsequent motion of the door.

Preferably, in the first motion, the motion of the door is tuned based on a change in at least one of a speed, a position, and a torque for operating the door.

In accordance with one aspect of the present disclosure, there is provided an apparatus for controlling a stall of an elevator door occurring during opening or closing of the elevator door, the apparatus comprising, a detector configured to detect a speed and an acceleration of a door; and a controller configured to determine an exceptional motion count of the door based on at least one of the speed and the acceleration of the door, and determine whether the door is stalled, based on a determined exceptional motion count of the door and a preset stall threshold level of the door.

In accordance with one aspect of the present disclosure, there is provided an apparatus for controlling a stall of an elevator door further comprising an actuator configured to move the door according to a motion control command by the controller, wherein, when the door approaches a predetermined stall position, the controller performs at least one of applying a subsequent motion control command to the actuator and re-determining the stall threshold level such that the stall threshold level with respect to the stall position is increased by a predetermined increment.

Preferably, when receiving the subsequent motion control command, the actuator tunes a motion of the door based on a change in at least one of a speed, a position, and a torque for operating the door.

Objects of the present disclosure are not limited to the above-described objects and other objects and advantages can be appreciated by those skilled in the art from the following descriptions. Further, it will be easily appreciated that the objects and advantages of the present disclosure can be practiced by means recited in the appended claims and a combination thereof.

DETAILED DESCRIPTION

Figure 1:
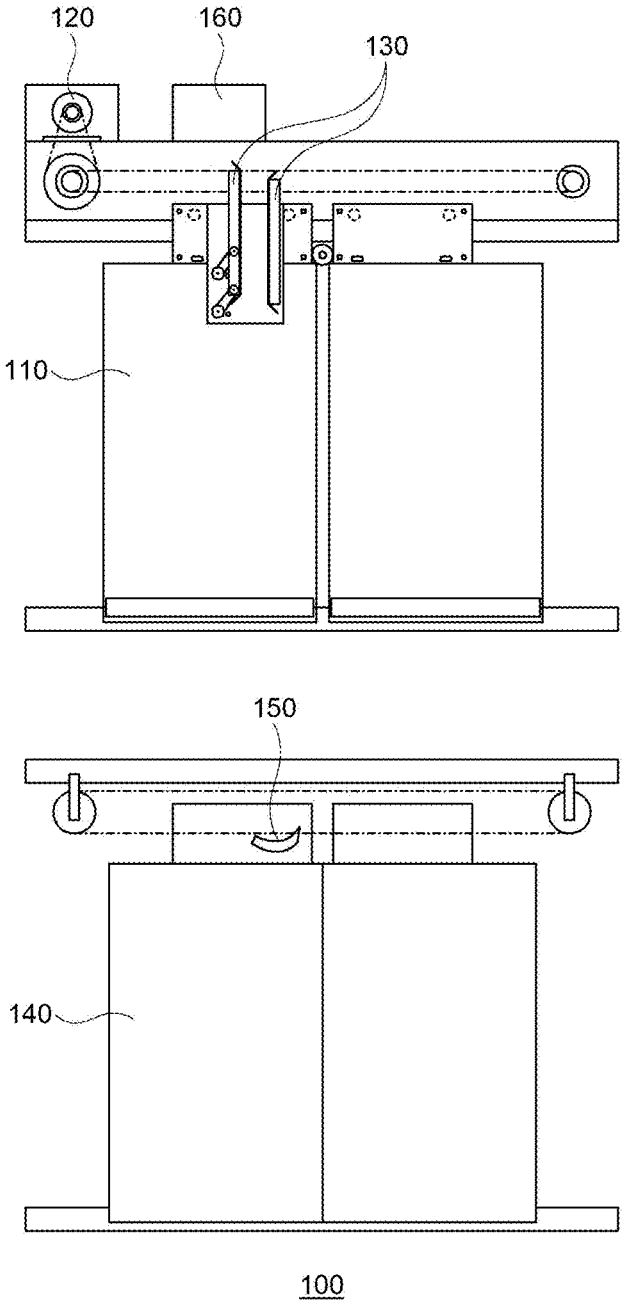
FIG. 1 schematically illustrates an elevator door system according to an embodiment of the present disclosure.

The above objects, features and advantages will become apparent from the detailed description with reference to the accompanying drawings. Embodiments are described in sufficient detail to enable those skilled in the art in the art to easily practice the technical idea of the present disclosure. Detailed descriptions of well known functions or configurations may be omitted in order not to unnecessarily obscure the gist of the present disclosure. Hereinafter, embodiments of the present disclosure will be described in detail with reference to the accompanying drawings. Throughout the drawings, like reference numerals refer to like elements.

FIG. 1 schematically illustrates an elevator door system 100 according to an embodiment of the present disclosure.

The elevator door system 100 may include a car door 110 installed on an elevator car moving along a hoistway and a landing door 140 installed on a platform of each floor where passengers get on the elevator car.

When the elevator car arrives at a platform of a floor where the elevator car is supposed to be stopped, a door controller 160 drives a motor 120 installed at the car door 110 to first open the car door 110 and then open a landing door 140 after unlocking a landing door lock device 150 by using a coupler 130 attached to the car door 110. As the landing door 140 that is mechanically coupled with the car door 110 is opened, an elevator door opens and thus passengers may get on or off. When passengers getting on or off is completed, the door controller 160 drives the motor 120 to close the car door 110 and thus the landing door 140 mechanically coupled with the car door 110 is closed together. Accordingly, the elevator door is in a closed state.

The door controller 160 has at least one stored motion parameter related to a motion of the elevator door and controls the motion of the elevator door according to the motion parameters. The motion parameters may include, for example, static parameters such as an opening width of a door, and a door mass, and other parameters such as a door speed, a door acceleration, a door stall position, a door stall level, and a count or threshold value related to various motions.

The door controller 160 controls a door motion by a feedback control mechanism based on a value of at least one motion parameter. The door controller 160 calculates a door speed command and a position command from the at least one motion parameter and controls the motor 120 to operate the door to follow a speed and a position instructed by the calculated speed command and position command, and receives a value of an encoder connected to the motor 120 and detects actual speed and position of the door. The door controller 160 calculates the speed command and the position command based on the actual speed and position of the door received from the encoder, and transmits the calculated commands to the motor 120. Accordingly, the motor 120 is driven at an updated speed and to an updated position and thus the elevator door is actually opened or closed.

In the control process of a door motion, when an exceptional motion of the door is detected, the door controller 160 increases a value of at least one motion parameter such that an exceptional motion count, and when the exceptional motion count exceeds a preset stall threshold level, the door controller 160 determines that the door is stalled. In other words, the stall threshold level may denote the maximum value of the exceptional motion count that may be negligible in the door control process. After the installation of an elevator is completed, an appropriate door stall threshold level needs to be set to the door controller 160 through learning run.

The elevator door stall control according to an embodiment of the present inventive concept is described below with reference to the accompanying drawings.

Figure 2:
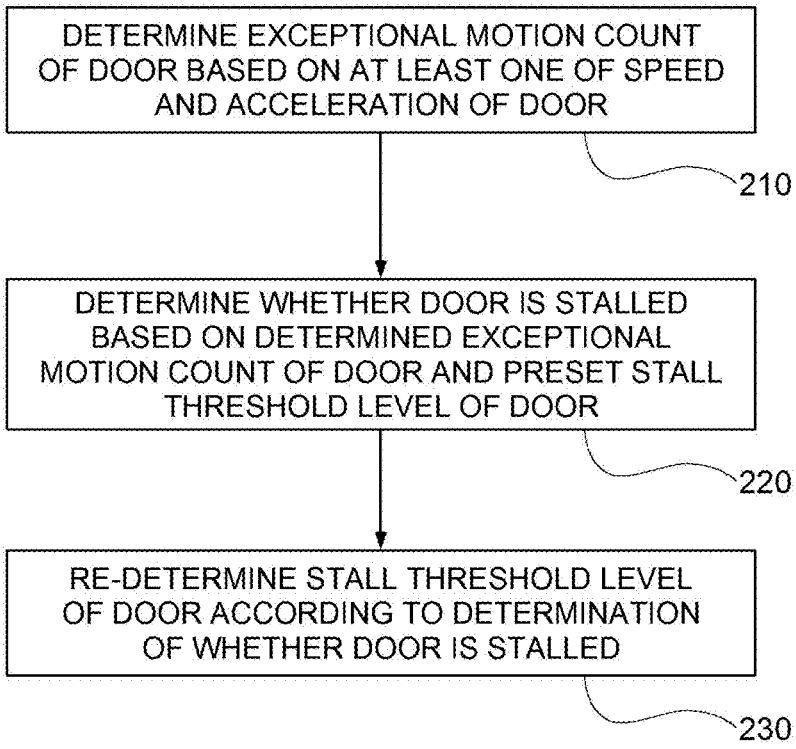
FIG. 2 is a flowchart for explaining a method of updating a door stall threshold level, according to an embodiment of the present disclosure.

FIG. 2 is a flowchart for explaining a method of updating a door stall threshold level, according to an embodiment of the present disclosure.

Figure 5:
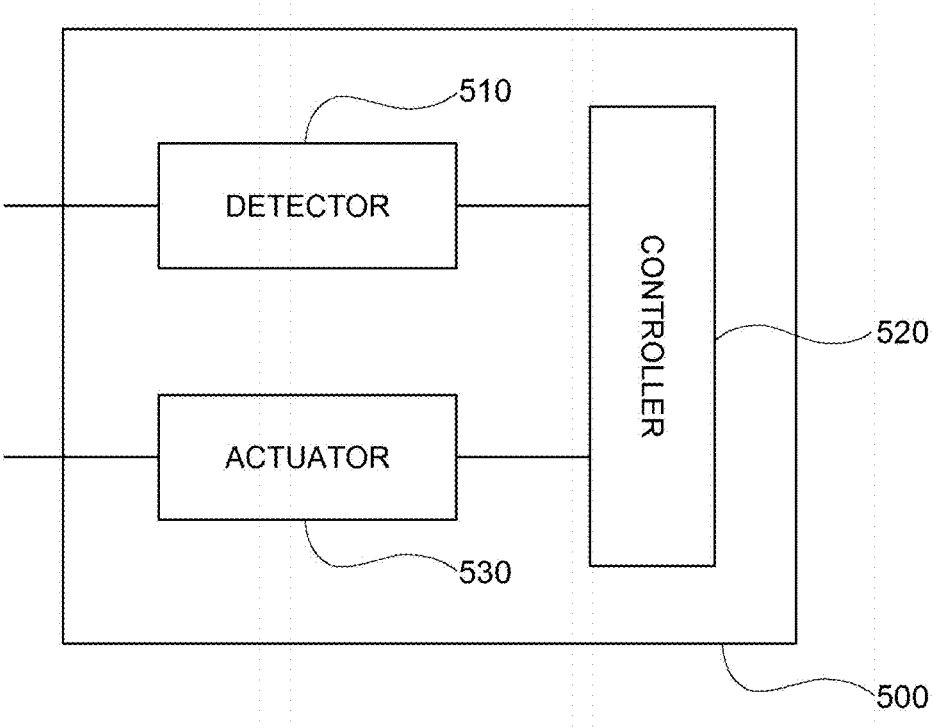
FIG. 5 is a block diagram of an apparatus for controlling stall of an elevator door, according to an embodiment of the present disclosure.

A controller 520 illustrated in FIG. 5 may determine an exceptional motion count of a door based on at least one of the speed and acceleration of the door (210).

In an embodiment, the exceptional motion count may be determined with respect to at least one preset position on a pathway of the door. The preset position based on which the exceptional motion count is determined may be, for example, all positions on the pathway of the door, a position spaced apart at a certain interval, a random position, a position determined according to a door speed profile, or a stall position, but the present disclosure is not limited thereto.

The controller 520 may determine an exceptional motion count of the door based on at least one of the speed and acceleration of a door detected by a detector 510 of FIG. 5. The detected speed of a door may be determined by a movement distance of the door for a specific time, and the detected acceleration of a door may be determined by a change in the speed of the door for a specific time. Each of the amounts of the specific time for determining the speed of a door and the specific time for determining the acceleration of a door may be set to a predetermined value, or may be dynamically set based on at least one of, for example, the position, speed, and acceleration of a door and the distance from a current position to the stall position.

The exceptional motion count may be determined by increasing a current value of the exceptional motion count by a predetermined increment based on at least one of the detected speed and acceleration of a door. The predetermined increment may be an integer greater than or equal to 1. The predetermined increment may be weighted based on at least one of the detected speed and acceleration of a door. In another embodiment, the exceptional motion count may be determined by decreasing the current value of the exceptional motion count by a predetermined decrement based on at least one of the speed and acceleration of a door.

Figure 3:
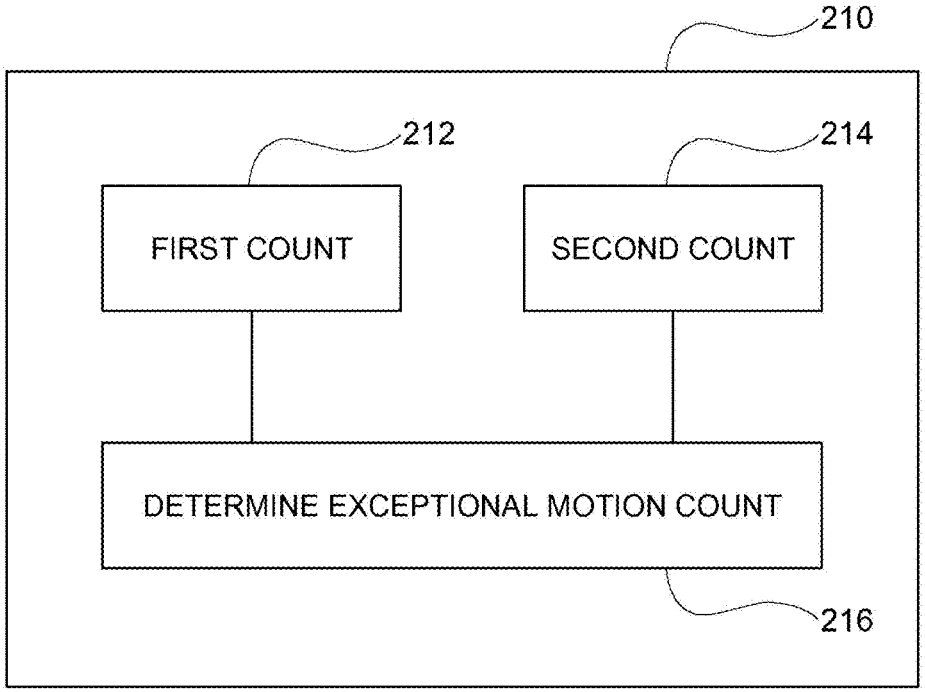
FIG. 3 is a block diagram showing an operation of determining an exceptional motion count of a door, according to an embodiment of the present disclosure.

FIG. 3 is a block diagram showing an operation of determining an exceptional motion count of a door, according to an embodiment of the present disclosure.

The controller 520 may increase a first count A 212 when the speed of a door is less than a minimum acceptable speed.

$$\text{First Count} \quad \text{if}\left[\frac{\Delta d\ (\text{distance moved})}{\Delta t\ (\text{time})} < \text{Minimum Acceptable Speed}\right] \tag{A}$$

The controller 520 may increase a second count B 214 when the acceleration of a door is greater than maximum acceptable acceleration.

$$\text{Second Count} \quad \text{if}\left[\left|\frac{\Delta v\ (\text{velocity})}{\Delta t\ (\text{time})}\right| > \text{Maximum Acceptable Accelaration}\right] \tag{B}$$

The controller 520 may determine an exceptional motion count based on at least one of the first count A and the second count B (216). In an embodiment, an exceptional motion count C may be determined by producing a first weighted count and a second weighted count by applying weights α and β to the first count A and the second count B, respectively, and summing the first weighted count and the second weighted count.

$$\text{Exceptional Motion Count}(c)=\alpha*(A)+\beta*(B)$$

In an embodiment, each of the weights α and β may be set by a predetermined value or may be dynamically set based on at least one of, for example, the position, speed, and acceleration of a door and the distance from a current position to a stall position.

In an embodiment, the minimum acceptable speed and the maximum acceptable acceleration usable for determining the first count A and the second count B may be determined based on at least one of a position on the pathway of a door and a movement speed profile of a door.

Referring back to FIG. 2, the controller 520 may determine whether the door is stalled based on the determined exceptional motion count of a door and the preset stall threshold level of a door (220).

In an embodiment, the controller 520 may determine that the door is stalled when the determined exceptional motion count of a door is greater than or equal to the preset stall threshold level of a door. In other words, when the exceptional motion count of a door is less than the preset stall threshold level of a door, the controller 520 may determine that the exceptional motion is a negligible exceptional motion. The preset stall threshold level of a door may be set to a default value, a value of a stall threshold level determined and updated in a preceding door stall threshold level update process in the controller 520, or a value appropriate to each position of a door at which the speed or acceleration of a door changes over a speed profile of a door.

The controller 520 may re-determine the stall threshold level of a door according to the determination of whether the door is stalled (230).

In an embodiment, when the door is determined in the operation 220 to be stalled, the controller 520 may determine in the operation 230 that a current position of a door to be a stall position. In an embodiment, the controller 520 may re-determine a value obtained by increasing the door stall threshold level preset in the operation 230 by a predetermined increment to be a stall threshold level with respect to the determined stall position. The predetermined increment may be an integer greater than or equal to 1. The predetermined increment may be weighted based on at least one of the detected speed and acceleration of a door. In the present disclosure, the increasing the preset door stall threshold level by the predetermined increment may signify an increase of tolerance with respect to the exceptional motion of a door at the stall position when the door is opened or closed after the stall threshold level is updated. Accordingly, the door stall due to an elevator installation state repeatedly occurring at the same position may not be considered as a door stall needing addressing.

In an embodiment, the stall threshold level of a door may be set to be a different value according to each position on the pathway of a door on a platform. In an embodiment, the stall threshold level of a door may be set to be a different value according to a floor where the elevator is supposed to be stopped. Accordingly, the stall threshold level may be automatically set according to each floor and each position on the pathway of a door, and the stall threshold level may be differently set for each position and each floor according to the installation state of an elevator.

The controller 520 may store the determined stall position and a stall threshold level for the determined stall position. The determined stall position and stall threshold level may be transferred to an elevator worker, an operator, or a maintenance service company to be used as a guideline for checking an elevator installation state.

In an embodiment, the operations 210 to 230 may be automatically started according to whether the predetermined stall threshold level of a door is updated or may be manually started by an external command. The controller 520 may store information about whether the stall threshold level of a door is updated, and may use the information as a value indicating whether the predetermined stall threshold level of a door is updated. When the door stall threshold level update by the operations 210 to 230 is completed, the controller 520 may store the value indicating that the update of the stall threshold level of a door is completed. The value indicating whether the predetermined stall threshold level of a door is updated may be determined by whether the stall position of a door is determined or by whether the door is in a factory initialization state. The external command may be transferred to the controller 520 via an external device capable of communicating with the controller 520.

Figure 4:
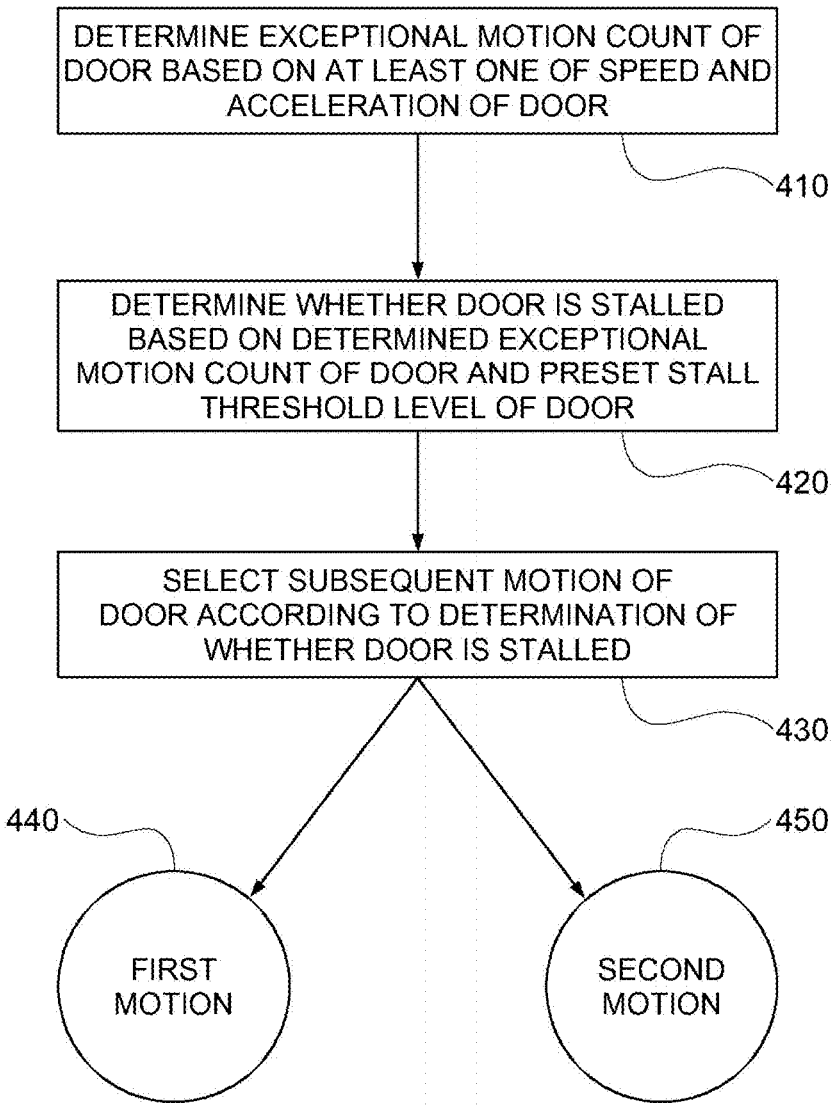
FIG. 4 is a flowchart of a method of controlling an elevator door stall, according to an embodiment of the present disclosure.

FIG. 4 is a flowchart of a method of controlling an elevator door stall, according to an embodiment of the present disclosure.

The controller 520 may determine an exceptional motion count of a door based on at least one of the speed and acceleration of a door by the same process as the operation 210 of FIG. 2 (410). The controller 520 may determine whether the door is stalled based on the determined exceptional motion count of a door and the preset stall threshold level of a door by the same process as the operation 220 of FIG. 2 (420).

The controller 520 may select a subsequent motion of a door according to the determination of whether the door is stalled (430). When the door is determined to be stalled, the controller 520 may select at least one of a first motion 440 of tuning the motion of a door when the door approaches a stall position and a second motion 450 of increasing the determined stall threshold level by a predetermined increment as the subsequent motion of the door.

In an embodiment, the first motion 440 may control the door stall by tuning the door motion based on a change in at least one of a speed, a position, and a torque for operating the door. The at least one of the speed, position, and torque of a door may be controlled by a proportional, integral, and derivative gains control (PID). For example, the first motion 440 may perform smooth opening/closing of a door to overcome the door stall due to an elevator installation state repeatedly occurring at the same position, by increasing current for operating the door, following late a target position, or increasing torque applied to the motor 120.

In the second motion 450, the predetermined increment may be an integer greater than or equal to 1. The predetermined increment may be weighted based on at least one of the detected speed and acceleration of a door. The increasing the preset door stall threshold level by the predetermined increment may signify an increase of tolerance with respect to the exceptional motion of a door at the stall position when the door is opened or closed. Accordingly, the door stall due to an elevator installation state repeatedly occurring at the same position may not be considered as a door stall which should be handled by this logic.

FIG. 5 is a block diagram of an apparatus 500 for controlling stall of an elevator door, according to an embodiment of the present disclosure.

The door stall control apparatus 500 according to an embodiment of the present disclosure may include the detector 510 for detecting a speed and an acceleration of a door. In an embodiment, the detector 510 may detect a position and a speed of a door on a pathway according to time, and may calculate an acceleration of a door therefrom. In an embodiment, the detector 510 may detect other dynamic motion parameters of the door.

The door stall control apparatus 500 may include the controller 520. The controller 520 may determine an exceptional motion count of a door based on at least one of the speed and acceleration of a door, and determine whether the door is stalled, based on the determined exceptional motion count of a door and the preset stall threshold level of a door.

In an embodiment, the door stall control apparatus 500 may further include an actuator 530 for moving the door according to a door movement speed command by the controller 520. In an embodiment, when the door approaches a predetermined stall position, the controller 520 may perform at least one of applying an increased movement speed command to the actuator 530 and resetting the stall threshold level such that the stall threshold level with respect to the stall position is increased by the predetermined increment.

In an embodiment, the actuator 530 may include a motor for driving the door. When receiving the increased movement speed command from the controller 520, the actuator 530 may increase at least one of the current applied to the motor and the torque driving the motor.

Accordingly, the door stall control apparatus 500 configured as above according to the present embodiment may overcome the door stall due to the elevator installation state repeatedly occurring at the same position.

Figure 6:
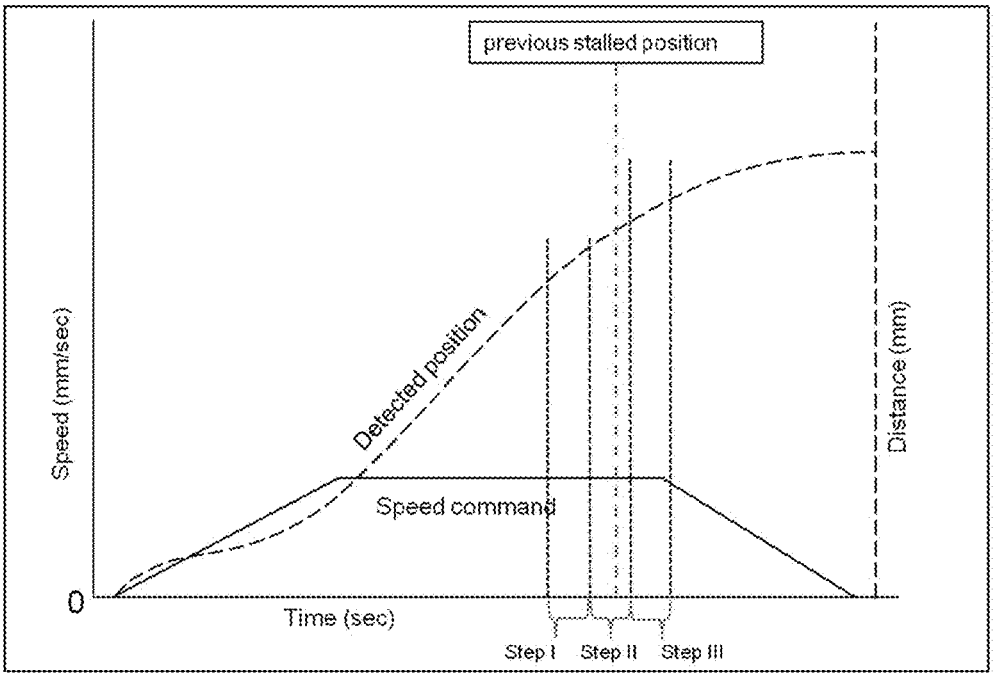
FIG. 6 is a graph showing a door stall position and a counter motion thereto with a door speed command and a detected position according to time, according to an embodiment of the present disclosure.

FIG. 6 is a graph showing a door stall position and a counter motion thereto with a door speed command and a detected position according to time, according to an embodiment of the present disclosure.

The actuator 530 moves a door according to a door speed command given by the controller 520. The movement of the door is detected by the detector 510 as the position of a door (detected position).

When the door approaches a preset stall position, the controller 520 may instruct at least one operation of steps 1, 2 and 3 for door stall control. For example, the step 1 may correspond to the first motion 440 of tuning the motion of a door based on a change in at least one of the speed and position for operating the door, the step 2 may correspond to the second motion 450 of increasing the determined stall threshold level by a predetermined increment, and the step 3 may correspond to the first motion 440 of increasing the speed of a door by increasing the amount of torque applied to the motor for operating the door. The order of the steps may be changed as necessary.

The present disclosure described above may be variously substituted, altered, and modified by those skilled in the art to which the present inventive concept pertains without departing from the scope and sprit of the present disclosure. Therefore, the present disclosure is not limited to the above-mentioned exemplary embodiments and the accompanying drawings.

What is claimed is:

1. A method of updating a stall threshold level of an elevator door to control a door stall occurring during opening or closing of the elevator door, the method comprising:

determining an exceptional motion count of a door based on at least one of a speed and an acceleration of the door;

determining whether the door is stalled, based on a determined exceptional motion count of the door and a preset stall threshold level of the door; and re-determining the stall threshold level of the door according to the determination of whether the door is stalled;

selecting a subsequent motion of the door according to the determination of whether the door is stalled.

2. The method of claim 1, wherein, in the determining of the exceptional motion count, the exceptional motion count is determined with respect to at least one preset position on a pathway of the door.

3. The method of claim 1, wherein the determining of the exceptional motion count comprises:

if the speed of the door is less than a minimum acceptable speed, increasing a first count; and if the acceleration of the door is greater than a maximum acceptable acceleration, increasing a second count, wherein the exceptional motion count is determined based on at least one of the first count and the second count.

4. The method of claim 3, wherein the exceptional motion count is determined by summing a first weighted count and a second weighted count that are determined by applying a weight to each of the first count and the second count.

5. The method of claim 3, wherein each of the minimum acceptable speed and the maximum acceptable acceleration is determined based on at least one of a position on a pathway of the door and a movement speed profile of the door.

6. The method of claim 1, wherein, in the determining of whether the door is stalled, the door is determined to be stalled when the determined exceptional motion count is greater than or equal to the preset stall threshold level.

7. The method of claim 1, wherein, in the re-determining of the stall threshold level, a current position of the door is determined to be a stall position, and a value obtained by increasing the preset stall threshold level by a predetermined increment is re-determined as a stall threshold level with respect to the stall position.

8. The method of claim 1, wherein the stall threshold level is set to be a different value according to each position on the pathway of the door on a platform.

9. The method of claim 1, wherein the stall threshold level is set to be a different value according to each floor that the elevator is stopped.

10. The method of claim 1, being automatically started according to whether the preset stall threshold level of the door is updated or manually started by an external command.

11. A method of controlling a stall of an elevator door occurring during opening or closing of the elevator door, the method comprising:

determining an exceptional motion count of a door based on at least one of a speed and an acceleration of the door;

determining whether the door is stalled, based on a determined exceptional motion count of the door and a preset stall threshold level of the door; and selecting a subsequent motion of the door according to the determination of whether the door is stalled, wherein, in the selecting of the subsequent motion, when the door approaches a stall position, at least one of a first motion of tuning a motion of the door and a second motion of increasing a determined stall threshold level by a predetermined increment is selected as the subsequent motion of the door.

12. The method of claim 11, wherein, in the first motion, the motion of the door is tuned based on a change in at least one of a speed, a position, and a torque for operating the door.

13. An apparatus for controlling a stall of an elevator door occurring during opening or closing of the elevator door, the apparatus comprising:

a detector configured to detect a speed and an acceleration of a door; and a controller configured to determine an exceptional motion count of the door based on at least one of the speed and the acceleration of the door, and determine whether the door is stalled, based on a determined exceptional motion count of the door and a preset stall threshold level of the door.

14. The apparatus of claim 13, further comprising an actuator configured to move the door according to a motion control command by the controller, wherein, when the door approaches a predetermined stall position, the controller performs at least one of applying a subsequent motion control command to the actuator and re-determining the stall threshold level such that the stall threshold level with respect to the stall position is increased by a predetermined increment.

15. The apparatus of claim 14, wherein, when receiving the subsequent motion control command, the actuator tunes a motion of the door based on a change in at least one of a speed, a position, and a torque for operating the door.

* * * * *